US008544911B2

(12) United States Patent
Chen

(10) Patent No.: US 8,544,911 B2
(45) Date of Patent: Oct. 1, 2013

(54) HOLDING DEVICE

(75) Inventor: Wen-Sheng Chen, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 108 days.

(21) Appl. No.: 13/178,660

(22) Filed: Jul. 8, 2011

(65) Prior Publication Data

US 2012/0112483 A1 May 10, 2012

(30) Foreign Application Priority Data

Nov. 4, 2010 (CN) ..... 2010 1 0531913

(51) Int. Cl.
*A47B 97/00* (2006.01)
*B66C 1/02* (2006.01)

(52) U.S. Cl.
USPC ..... 294/65; 294/87.1; 414/737; 414/752.1

(58) Field of Classification Search
USPC ..... 294/183, 188, 65, 87.1; 414/752.1, 414/737, 627
See application file for complete search history.

(56) References Cited

U.S. PATENT DOCUMENTS

| | | | | |
|---|---|---|---|---|
| 6,145,901 | A * | 11/2000 | Rich | 294/189 |
| 6,264,419 | B1 * | 7/2001 | Schinzel | 414/751.1 |
| 6,485,285 | B1 * | 11/2002 | Shiotani | 425/139 |
| 7,004,522 | B2 * | 2/2006 | Nagai et al. | 294/185 |
| 7,100,955 | B2 * | 9/2006 | Nakamura | 294/65 |
| 7,234,744 | B2 * | 6/2007 | Osten et al. | 294/65 |
| 2002/0003353 | A1 | 1/2002 | Massow | |
| 2003/0147736 | A1 | 8/2003 | Nagai et al. | |
| 2006/0017298 | A1 | 1/2006 | Osten et al. | |

FOREIGN PATENT DOCUMENTS

CN 201058765 Y 5/2008

* cited by examiner

*Primary Examiner* — Stephen Vu
(74) *Attorney, Agent, or Firm* — Altis Law Group, Inc.

(57) ABSTRACT

A holding device includes a fixing base, a rotary driving member, a first positioning member, a first holding assembly, a second holding assembly, and a second positioning member. The rotary driving member and the first positioning member are mounted on the fixing base. The first holding assembly and the second holding assembly are driven by the rotary driving member to rotate about a rotation axis. The first positioning member can move relative to the second positioning member to engage with the second positioning member, to position the first holding assembly and the second holding assembly. The first holding assembly and the second holding assembly can move separately to complete different tasks.

18 Claims, 3 Drawing Sheets

HOLDING DEVICE

BACKGROUND

1. Technical Field

The present disclosure relates to holding devices.

2. Description of Related Art

During an automatic machining process, a film is generally attached to a workpiece to protect it, such as from being anodized. First, the workpiece is fixed on a platform, and a holding member with a suction cup holds the film. The holding member is then moved to a predetermined position opposite to the suction cup, until the film is attached to the workpiece. However, the holding member cannot hold another film when a film is attached to the workpiece, thus the packing efficiency of the workpiece is reduced. Additionally, the holding member cannot accurately stop at a predetermined place because of inertia, therefore reducing precision.

Therefore, there is room for improvement within the art.

BRIEF DESCRIPTION OF THE DRAWINGS

The elements in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
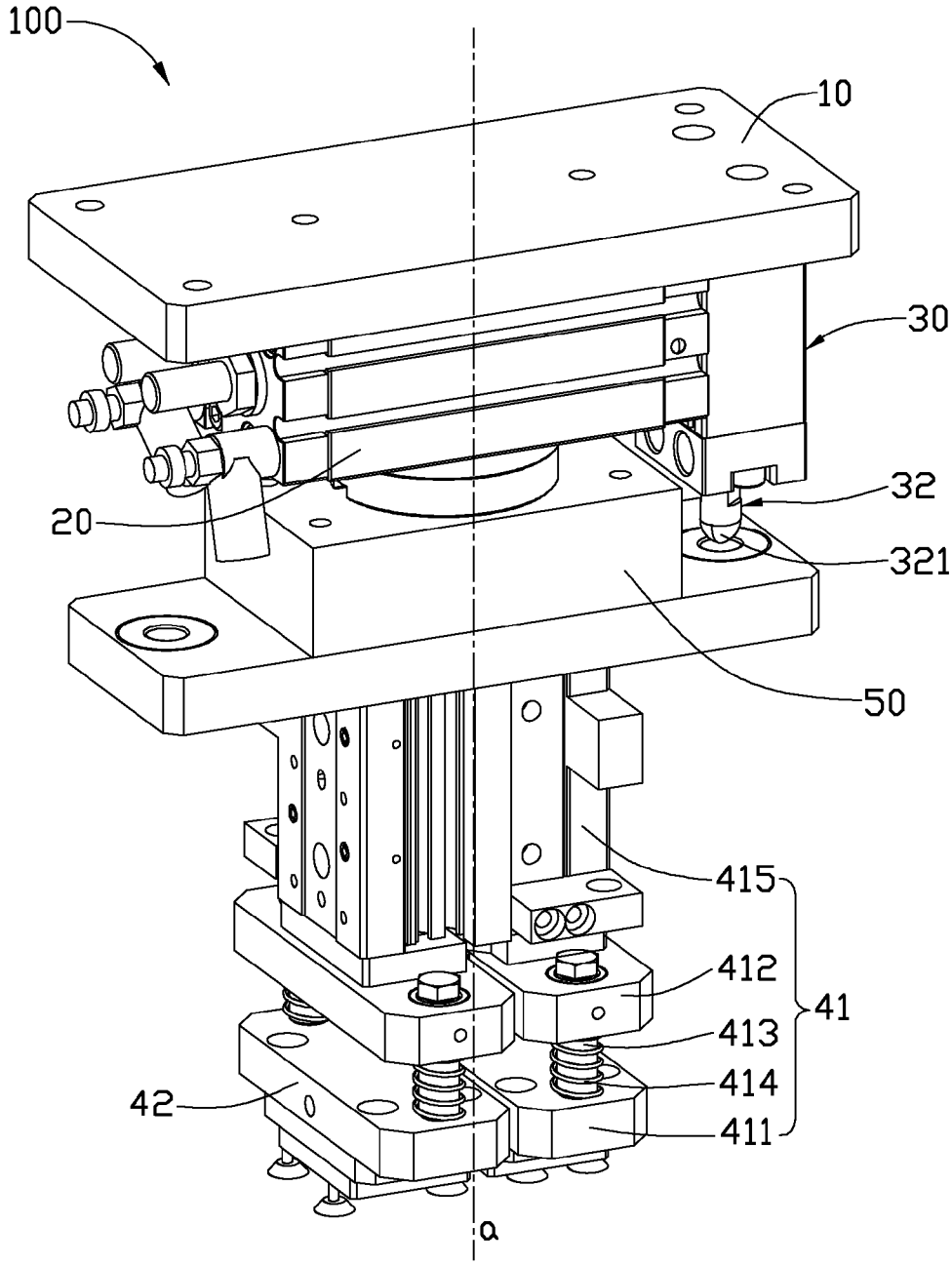
FIG. 1 is an isometric view of an embodiment of a holding device.

Referring to FIG. 1, an embodiment of a holding device 100 includes a fixing member 10, a rotary driving member 20, a first positioning member 30, a first holding assembly 41, a second holding assembly 42, and a second positioning member 50. The rotary driving member 20 and the first positioning member 30 are mounted on the fixing member 10. The second positioning member 50 connects the first holding assembly 41 and the second holding assembly 42 to the rotary driving member 20, such that the first holding assembly 41 and the second holding assembly 42 are driven by the rotary driving member 20, and rotate about a rotation axis. The first positioning member 30 can move relative to the second positioning member 50, and then engage with the second positioning member 50, such that the first holding assembly 41 and the second holding assembly 42 can stop at a predetermined place relative to the fixing member 10.

Figure 2:
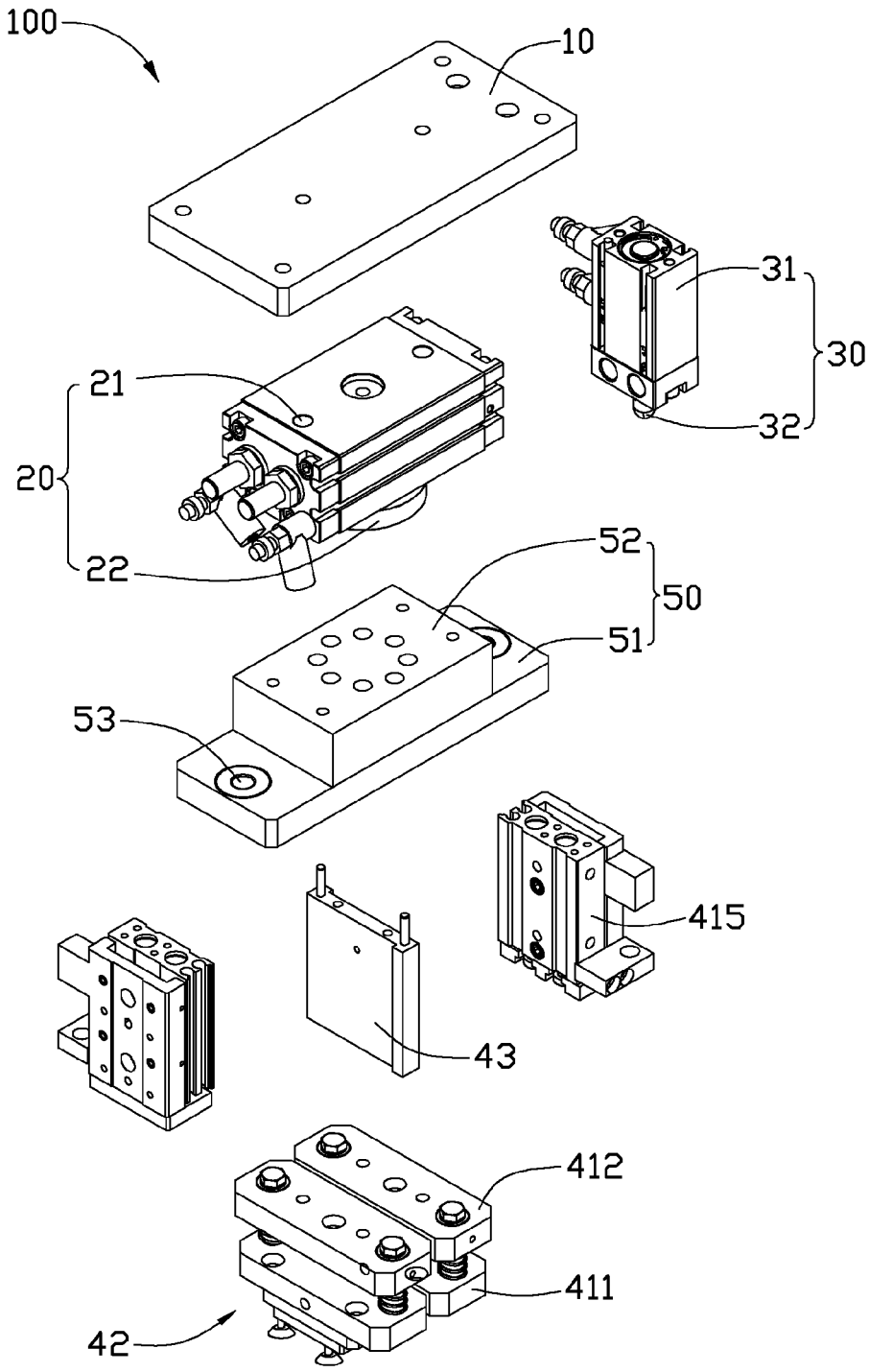
FIG. 2 is an exploded, isometric view of the holding device of FIG. 1.

Referring also to FIG. 2, the rotary driving member 20 includes a rotary body 21 and a rotary shaft 22. The rotary shaft 22 is placed on a center of the rotary body 21, and is securely connected to the second positioning member 50, to drive the second positioning member 50 to rotate about the rotation axis. In the illustrated embodiment, the rotary driving member 20 is a rotating cylinder with a rotating angle of about 180 degrees. It is noted that the rotary driving member 20 can also be a motor.

The first positioning member 30 includes a linear driving member 31 and a positioning portion 32. The positioning portion 32 is connected to, and is driven by the linear driving member 31. The positioning portion 32 is a positioning post in this embodiment, and includes an arcuate guiding surface 321. A center of the positioning portion 32 is away from the rotation axis by a predetermined distance between the center of the positioning portion 32 and the rotation axis. In the illustrated embodiment, the linear driving member 31 is a cylinder. It is noted that the linear driving member 31 can also be other driving structures, such as motor.

The first holding assembly 41 includes a holding portion 411, a retaining portion 412, a connecting shaft 413, a cushion portion 414, and a driving member 415. The connecting shaft 413 connects the holding portion 411 to the retaining portion 412. The cushion portion 414 is sleeved on the connecting shaft 413, to cushion a collision force generated between the holding portion 411 and a workpiece. The driving member 415 is securely connected to the retaining portion 412, to drive the holding portion 411 to move. In the illustrated embodiment, the holding portion 411 employs a suction cup structure, to adsorb the film. The cushion portion 414 can be a coiled spring. The holding portion 411 is driven by the driving member 415 to move along the direction substantially parallel to the rotation axis. It is noted that the holding portion 411 can also be a clamping jaw.

The second holding assembly 42 has the same structure as the first holding assembly 41. The second holding assembly 42 and the first holding assembly 41 can move separately to complete different tasks. The connecting member 43 connects the first holding assembly 41 and the second holding assembly 42 to the second positioning member 50 such that the first holding assembly 41 and the second holding assembly 42 can rotate about the rotation axis.

The second positioning member 50 includes a main body 51 and a connecting portion 52. The main body 51 is plate-shaped. The connecting portion 52 is placed on a center of the main body 51, and is connected to the rotary shaft 22 of the rotary driving member 20 and the connecting member 43. Two engaging portions 53 are placed on opposite ends of the main body 51 away from the rotation axis. In the illustrated embodiment, the two engaging portions 53 are placed on an imaginary circle with a center aligned with the rotation axis. The engaging portion 53 is a positioning hole engaging with the positioning portion 32 of the first positioning member 30, and is defined in the main body 51. When the rotary driving member 20 stops after rotating about 180 degrees, the positioning portion 32 moves to the engaging portion 53 driven by the linear driving member 31, such that the positioning portion 32 is engaged with the engaging portion 53 to stop the second positioning member 50 from moving by inertia, thus improving the positioning precision of the first holding assembly 41 and the second holding assembly 42. The positioning portion 32 can easily slide in the engaging portion 53 because the guiding surface 321 of the position portion 32 is arcuate.

Figure 3:
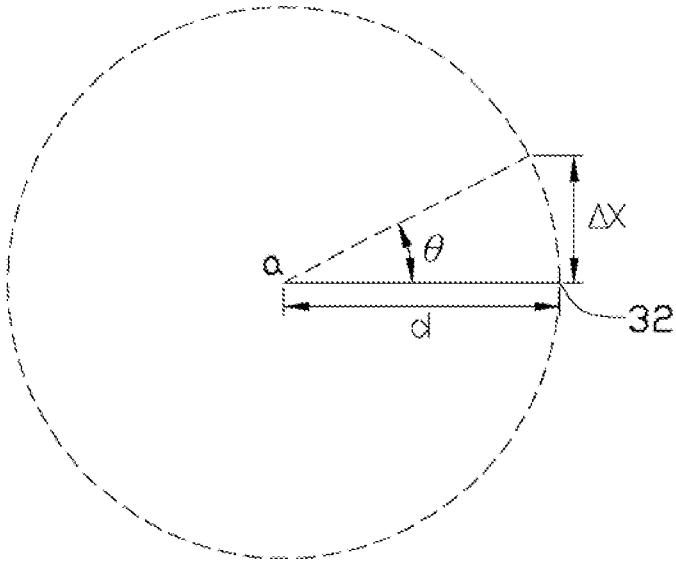
FIG. 3 is a schematic diagram of the positioning precision of the holding device of FIG. 1.

Referring also to FIG. 3, in the illustrated embodiment, a matching error between the positioning portion 32 and the engaging portion 53 is $\Delta\chi$, and a distance from the center of the positioning portion 32 to the rotation axis is $\kappa$. The positioning deviation angle $\theta$ of the first holding assembly 41 and the second holding assembly 42 can be calculated by the formula (1):

$$\theta = \frac{\Delta\chi}{\kappa} * \frac{360}{2\pi} = \frac{180\Delta\chi}{\pi\kappa} \tag{1}$$

It is noted that the greater the distance from the center of the positioning portion 32 to the rotation axis, the larger the positioning deviation angle $\theta$, and the higher the positioning precision or the machining precision. It is noted that the number of the engaging portions 53 can also be greater than two, to position the first holding assembly 41 and the second holding assembly 42 at other positions.

When the holding device 100 is in operation, the first holding assembly 41 first adsorbs a film at an original position. The film is then attached to a first portion of the workpiece. After attaching the film to the first portion, the first holding assembly 41 and the second holding assembly 42 are rotated by the rotary driving member 20 to about 180 degrees. The first positioning member 30 moves to the second positioning member 50, such that the positioning portion 32 is engaged with the engaging portion 53 to position the first holding assembly 41 and the second holding assembly 42. The second holding assembly 42 then adsorbs another film, which is attached to a second portion of the workpiece, and at the same time, the first holding assembly 41 adsorbs another film. The above-mentioned process can be continuously repeated to attach films to different workpieces.

Because the first holding assembly 41 and the second holding assembly 42 can complete different tasks at the same time, the work efficiency is improved. The first holding assembly 41 and the second holding assembly 42 are driven by the rotary driving member 20, and the positioning portion 32 is engaged with the engaging portion 53 to position the first holding assembly 41 and the second holding assembly 42, so that the films can be attached to different portions of the workpiece without rotating the workpiece, thereby improving the work efficiency and machining precision. The holding device 100 is compact and can be mounted easily onto other machining devices.

It is to be understood, however, that even through numerous characteristics and advantages of the disclosure have been set forth in the foregoing description, together with details of the structure and function of the embodiment, the disclosure is illustrative only, and changes may be made in detail, especially in matters of shape, size, and arrangement of parts within the principles of the embodiment to the full extent indicated by the broad general meaning of the terms in which the appended claims are expressed.

What is claimed is:

1. A holding device, comprising:

a fixing base;

a rotary driving member mounted on the fixing base;

a first positioning member mounted on the fixing base comprising a positioning portion;

a first holding assembly driven by the rotary driving member and rotating about a rotation axis, the first holding assembly comprising a holding portion and a driving member driving the holding portion;

a second holding assembly driven by the rotary driving member and rotating about the rotation axis, the second holding assembly comprising a holding portion and a driving member driving the holding portion of the second assembly; and a second positioning member connecting the first holding assembly and the second holding assembly to the first positioning member, wherein the second positioning member comprises an engaging portion engaging with the positioning portion, the positioning portion and the engaging portion are away from the rotation axis by a predetermined distance, the first positioning member moves relative to the second positioning member to engage with the second positioning member to position the first holding assembly and the second holding assembly, and the first holding assembly and the second holding assembly are capable of moving separately to complete different tasks.

2. The holding device of claim 1, wherein the holding portion of the first holding assembly is driven by the driving member of the first holding assembly to move along a direction substantially parallel to the rotation axis, and the holding portion of the second holding assembly is driven by the driving member of the second holding assembly to move along a direction substantially parallel to the rotation axis.

3. The holding device of claim 1, wherein the holding portion of the first holding assembly or of the second holding assembly comprises a suction cup.

4. The holding device of claim 1, wherein the second positioning member comprises three or more engaging portions, and the engaging portions are placed within an imaginary circle with a center substantially aligned with the rotation axis.

5. The holding device of claim 1, wherein the positioning portion comprises a positioning post, and the engaging portion is a positioning hole defined in the second positioning member.

6. The holding device of claim 5, wherein the positioning post comprises an arcuate guiding surface.

7. The holding device of claim 1, wherein the first positioning member further comprises a linear driving member to drive the positioning portion to move to the engaging portion.

8. The holding device of claim 1, wherein the first holding assembly further comprises a retaining portion opposite to the holding portion of the first holding assembly, a connecting shaft connecting the retaining portion to the holding portion of the first holding assembly, and a cushion portion sleeved on the connecting shaft.

9. The holding device of claim 8, the cushion portion comprises a coiled spring.

10. A holding device, comprising:

a fixing base;

a rotary driving member mounted on the fixing base;

a first positioning member mounted on the fixing base, and comprising a positioning portion;

a first holding assembly driven by the rotary driving member, and rotating about a rotation axis, the first holding assembly comprising a holding portion and a driving member driving the holding portion to move along a direction substantially parallel to the rotation axis;

a second holding assembly driven by the rotary driving member, and rotating about the rotation axis, wherein the second holding assembly comprises a holding portion and a driving member driving the holding portion of the second holding assembly to move along a direction substantially parallel to the rotation axis; and a second positioning member connecting the first holding assembly and the second holding assembly to the first positioning member, and comprising an engaging portion, wherein the positioning portion is capable of moving relative to and engaging with the engaging portion, to position the first holding assembly and the second holding assembly, and the first holding assembly and the second holding assembly is capable of moving separately to complete different tasks.

11. The holding device of claim 10, wherein the holding portion comprises a suction cup.

12. The holding device of claim 10, the positioning portion and the engaging portion are away from the rotation axis by a predetermined distance.

13. The holding device of claim 10, wherein the second positioning member comprises three or more engaging portions, and the engaging portions are placed within an imaginary circle with a center substantially aligned with the rotation axis.

14. The holding device of claim 10, wherein the positioning portion comprises a positioning post, and the engaging portion is a positioning hole defined in the second positioning member.

15. The holding device of claim 14, wherein the positioning post comprises an arcuate guiding surface.

16. The holding device of claim 10, wherein the first positioning member further comprises a linear driving member to drive the positioning portion to move to the engaging portion.

17. The holding device of claim 10, wherein the first holding assembly further comprises a retaining portion opposite to the holding portion of the first holding assembly, a connecting shaft connecting the retaining portion to the holding portion of the first holding assembly, and a cushion portion sleeved on the connecting shaft.

18. The holding device of claim 17, the cushion portion comprises a coiled spring.

* * * * *